United States Patent [19]

Hultsch et al.

[11] 4,130,944

[45] Dec. 26, 1978

[54] CENTRIFUGAL FLUIDIZED-BED DRYING METHOD AND APPARATUS

[75] Inventors: Günther Hultsch; Harald Bock, both of Munich, Germany

[73] Assignee: Krauss-Maffei Aktiengesellschaft, Munich, Germany

[21] Appl. No.: 798,486

[22] Filed: May 19, 1977

[30] Foreign Application Priority Data

May 20, 1976 [DE] Fed. Rep. of Germany ..... 2622565

[51] Int. Cl.[2] ..... F26B 5/08

[52] U.S. Cl. ..... 34/8; 34/58

[58] Field of Search ..... 34/8, 58

[56] References Cited

U.S. PATENT DOCUMENTS

| | | | |
|---|---|---|---|
| 3,525,161 | 8/1970 | Jesperson | 34/8 |
| 3,688,906 | 9/1972 | Ferrara | 34/58 |
| 3,821,857 | 7/1974 | Mercier | 34/8 |
| 4,035,925 | 7/1977 | Brown et al. | 34/8 |

*Primary Examiner*—Leland A. Sebastian

*Attorney, Agent, or Firm*—Karl F. Ross

[57] ABSTRACT

Particles to be dried are loaded into the bottom of an upwardly open vessel which is then spun about a central axis at a speed sufficient to form the particles into an annular body and to urge the particles radially outwardly with a centrifugal force greater than the force of gravity. The outer wall of the vessel is gas-pervious and drying gas is passed radially inwardly through this wall to contact the particles and at least partially fluidize the body of particles. The dried particles are drawn off out of the upper end of the rotating vessel as fresh wet particles are loaded into the lower end.

19 Claims, 5 Drawing Figures

60
59
A
56
60
61
54
82"
46
50
62
63
48
66
67
67
64
65
53
44
45
55
57
57
58
52
51
49
47

CENTRIFUGAL FLUIDIZED-BED DRYING METHOD AND APPARATUS

FIELD OF THE INVENTION

The present invention relates to a method of and apparatus for contacting particulate material with a fluid. More particularly this invention concerns a method of and apparatus for drying particles.

BACKGROUND OF THE INVENTION

It is known to treat particles with a fluid by passing the particles as a body in one direction and passing the fluid with which they are to be treated countercurrent to the particles. In the simplest method the particles are advanced along a support that is foraminous, that is either perforated or otherwise gas-pervious. As the particles more along this foraminous support the fluid for treating them is passed upwardly through the support and through the body of particles. This action fluidizes the body of particles, as the upwardly moving fluid at least partially counteracts the downwardly effective force of gravity so as to suspend these particles and convert the body of particles into a highly fluent mass. Such a system ensures intimate contacting of the fluid and the particles for excellent treatment of these particles, usually for drying of wet particles.

With particles of small surface density, that is ratio of surface area to mass, it is necessary to work with a relatively low fluid speed. If the fluid speed exceeds a predetermined limit for a given particle size the fluid will simply entrain the particle. For this reason a vigorous fluid flow can only be used with particles of relatively great surface density, so that the overall efficiency of such a system falls off directly with particle size. Thus the installations which serve to dry particles of very small surface density are inherently quite large and inefficient in operations.

OBJECTS OF THE INVENTION

It is therefore an object of the present invention to provide an improved method of and apparatus for treating particular material with a fluid.

Another object is an improved drying method and apparatus for particulate material of extremely small surface density or screen size.

Yet another object is to provide a method which allows relatively fine particles of pulverent size to be dried at a relatively high speed.

SUMMARY OF THE INVENTION

These objects are attained according to the present invention in a system wherein the particles are formed into a body that is centered on an axis and are rotated about this axis at a speed sufficient to urge the particles radially outwardly with a centrifugal force greater than the force of gravity. The treatment fluid normally a drying gas, is passed at least partially radially inwardly through the body to contact the particles and treat or dry them. The treatment fluid can be passed inwardly at a speed sufficient to at least partially fluidize the body at a speed which urges the particles inwardly with a force greater than the force of gravity to ensure excellent contacting of the treatment fluid and the particles without entraining them in the fluid stream.

Thus the particles can be suspended so that they are neither moved outwardly by the centrifugal force nor inwardly by the treatment fluid.

The system according to this invention therefore uses the effective increase in weight which is imparted to the particles when spun at high speed. Since the particles in effect become heavier when so moved, it is possible to displace the treatment fluid at a much higher speed so as greatly to increase the efficiency of the treatment. Indeed it is possible with the method according to this present invention to effectively increase the weight of the particles by a factory of twenty.

It is also possible to combine the treatment system according to this invention with a sorting system. Thus after some treatment of the particles in the manner described above the rotation speed of the body of particles can be decreased and/or the velocity of the gas passing through the particles can be increased so as to carry off the smaller particles. Also the system according to the present invention can be employed in such a manner that the particles are only light enough to be entrained by the gas stream when they are fully dried. It is also within the scope of this invention to use the arrangement as a simple contrifuge in the initial stages of drying to extract radially outwardly from the body of particles some of the moisture held therein.

According to a further feature of this invention the axis about which the body of particles is rotated is upright. The particles are supported in a vessel centered on this axis having an inner foraminous or gas-pervious wall and an outer gas-impervious wall spaced slightly radially outwardly from the inner gas-pervious wall. Particules are added to the body at one axial end of the vessel and are withdrawn at the opposite axial end. In addition according to this invention the fluid or gas used for treating the particles is introduced between the innwer and outer walls at that end of the housing where the particles are introduced and is directed at an angle of at most 10° to a perpendicular or radius from the axis. In this manner the gas stream itself moves the particles toward the outlet end of the vessel.

In accordance with this invention the particles are introduced into the vessel by means of a vertical inlet tube extending along the axis and terminating immediately above the base of the vessel, that is the base of the foraminous inner wall of the vessel. The particles may be blown down the tube, in which case the gas stream serving to convey them subsequently becomes part of an auger, or the tube may be vibrated to aid flow down it.

In addition according to this invention, the base of the vessel is provided around the lower outlet end of the feed tube with radially outwardly extending vanes that are fixed to and rotated with the vessel. Furthermore a distribution cone centered on the axis and pointed up into the outlet end of the feed tube may be employed to ensure that the particles are deflected radially outwardly as they are loaded into the apparatus. Interacting fixed vanes on the inlet tube and displaceable vanes or formations on the vessel may serve to break up lumps of the particles before they come to lie against the wall of the vessel. In accordance with this invention the drums may be generally cylindrical, having an upper outlet mouth of slightly smaller diameter than the drum or vessel. Since the particles normally become lighter as they dry and, therefore, move to the top or radially inward portion of the body, these particles will automatically flow to the upper outlet end of the vessel and flow over the lip thereof into a radially or tangentially opening outlet. They may also simply fall into a space between a fixed housing and the gas-impervious outer wall of the vessel and thence down and out through an outlet tube.

It is also within the scope of the invention to form the vessel as a frustoconical downwardly tapered drum so that the body of particles inherently is urged axially upwardly toward the outlet mouth. This outlet mouth may be constituted as a thin slot extending circumferentially around the vessel and opening radially into a particle outlet. In such an arrangement automatic sorting of the particles from the gas stream can easily be achieved. Vibration of the inner wall at least of the drum axially aids in flowing of the particles toward the outlet.

The system according to the present invention therefore makes it possible for a single apparatus taking up a relatively limited floor space to thoroughly treat particles with a fluid. The drive of the device may be made adjustable so that it can be set for any particle size of surface density, ensuring a rapid and effective treatment. The device can be incorporated in a sorting system so that as the particles are dried they are automatically sorted according to surface density.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
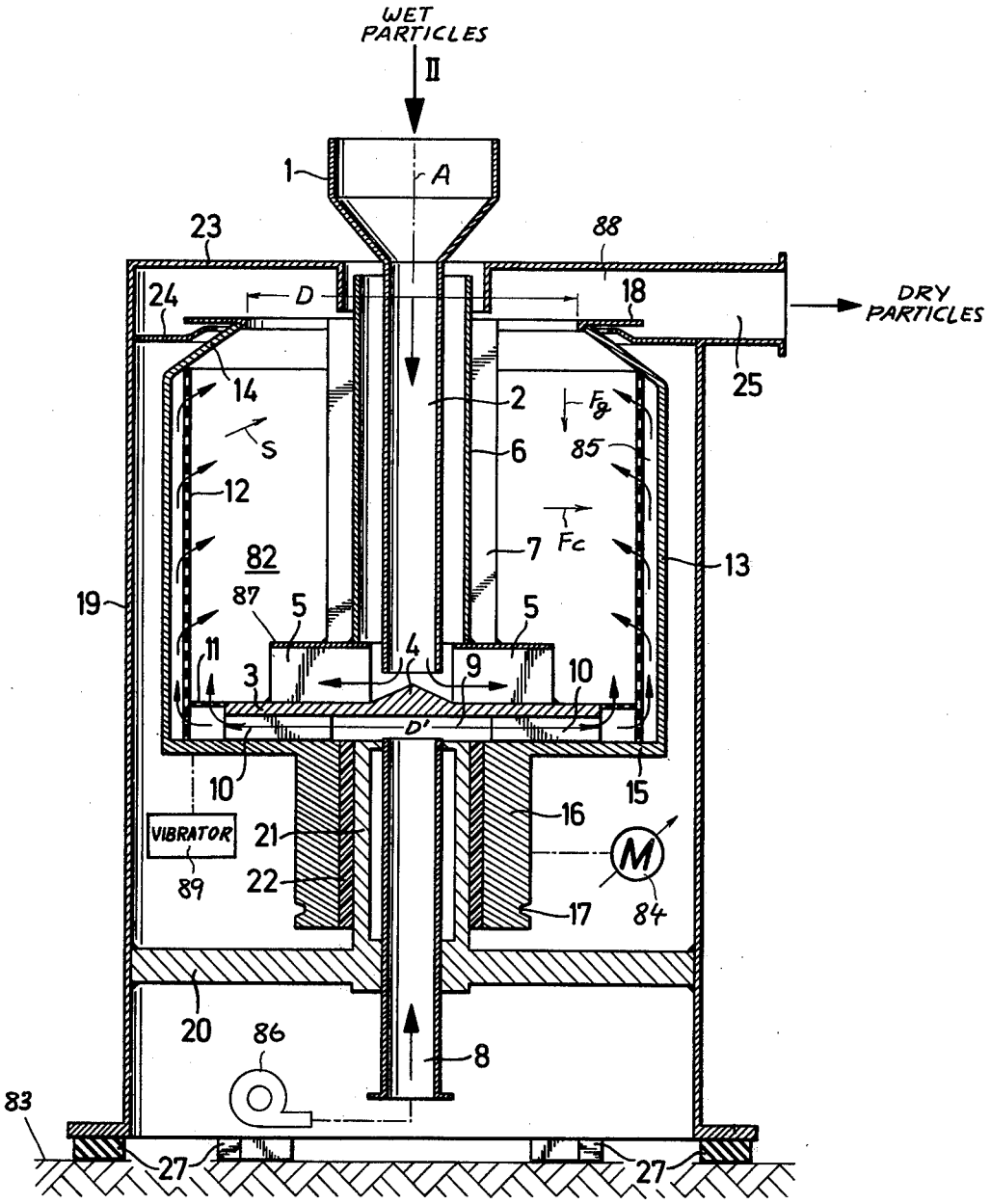
FIG. 1 is a vertical section through an apparatus according to this invention.
Figure 2:
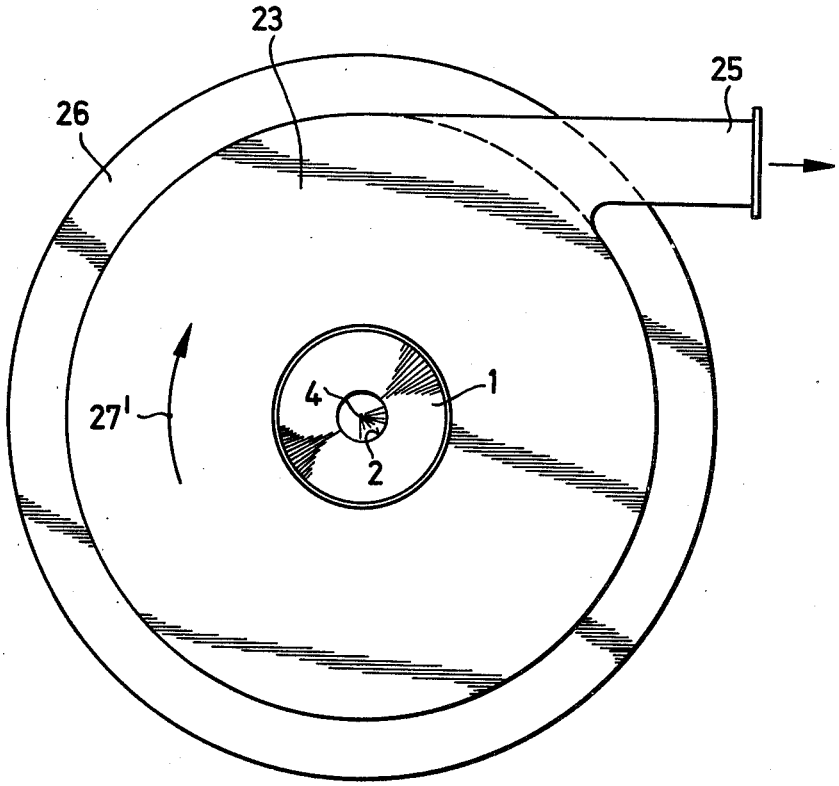
FIG. 2 is a view taken in the direction of arrow II of FIG. 1.

The apparatus according to this invention as best shown in FIGS. 1 and 2 has a fixed outer housing 19 mounted via a flange 26 and elastomeric cushions 27 on the ground 83. The housing 19 has a top wall 23 and a horizontal support partition 20 above the floor 83. This support or web 20 is formed with an upwardly extending cylindrical projection 21 centered like the housing 19 on a vertical axis A. The projection or extension 21 serves as journal for a synthetic-resin sleeve 22 supporting a cylindrical pulley 16 having a groove 17 in which is reeved a V-belt connected to a variable-speed drive motor 84.

An upwardly open vessel formed as a gas-impervious cylindrical outer wall 13 having a horizontal base or floor 15 connected to the pulley 16 and a gas-pervious or foraminous inner cylindrical wall 12 spearated by a space 85 from the outer wall 13 is rotatable about the axis A. At its upper end the cylindrical outer wall 13 has an inwardly extending frustoconical lip 14 with an inner periphery of a diameter D and having a planar flange 18 that extends outwardly from the upper edge of this lip 14. A circumferential spill plate 24 carried on the fixed housing 19 engages between the parts 14 and 18.

A variable-speed blower 86 has its output connected to the lower end of a tube 8 centered on the axis and fixed in the projection 21. The upper end of the tube 8 opens into a space 9 between a solid base 3 extending parallel to the base 15 and spaced therefrom by a multiplicity of radially extending vanes 10. The base part 3 has a diameter D' which is somewhat greater than the diameter D but smaller than the diameter of the foraminous wall 12. A planar and foraminous ring 11 is provided between the outer periphery of the part 3 and the inner wall 12.

A fixed inlet tube 2 has an upper end provided with a funnel or hopper 1 above the upper wall 23 and a lower end opening immediately above an upwardly pointed and axially centered distributing cone 4 provided on the base 3.

A plurality of short radially directed vanes having their outer ends spaced inwardly from the outer periphery of the part 3 and their inner ends spaced from the lower end of the tube 2 are welded to the top of the plate 3 and in turn carry an axially centered tube 6 extending upwardly around and spaced radially from the tube 2 to immediately adjacent the funnel 1 above the upper end of the vessel constituted by the walls 12 and 13 and their respective bases 3 and 15. A plurality of short radially extending entrainment vanes 7 extend from the top of an annular plate 87 welded to the top of the vanes 5 to the plane defined by the upper lip of the frustoconical portion 14 of the outer wall 13. Thus an annular space 82 is defined between the tubes 6 and foraminous wall 12.

The housing 19 is formed as best shown in FIG. 2 with a tangentially opening outlet 25 that opens axially into the region between the upper wall 23 and the spill plate 24.

In use wet particles which can be so fine as to have pulverent flour-like consistency are loaded axially downwardly into the hopper 1. At the same time the motor 84 rotates the entire vessel 12, about the axis A at high speed. Thus as the particles drop down onto the distributing cone 4 they will be projected centrifugally outwardly as shown by the arrows. The vanes 5 ensure that the particles will be rotationally entrained, and the vanes 7 ensure that the air inside the chamber 82 is similarly rotationally entrained.

The blower 86 is meanwhile operated at such a speed as to pass a gas, normally merely hot air, upwardly through the tube 8 so it is distributed radially outwardly from the space 9 to flow up through the ring 11 and inwardly through the wall 12 as indicated by the arrows. Once again the vanes 10 here insure that the air from the blower 86 will also be rotationally entrained. The air exits from the holes in the perforated wall 12 in a direction S which forms an angle of at most 10° to a perpendicular radius of the axis A. In FIG. 1 this dimension is shown somewhat exaggerated for clarity.

The motor 84 rotates the drum assembly at such a speed that the particules fed in through the inlet tube 2 are forced radially against the wall 12 with a force Fc which is many times greater than the downwardly effective force of gravity Fg. Indeed the centrifugal force Fc may be as much as twenty times greater than the gravitational force Fg. The blower 86 is operated at a speed to force the air radially inwardly through the foraminous wall so fast that it exerts an inwardly effective force greater than the gravitational force Fg on the particules driven centrifugally against this wall 12. This inwardly effective force is, however, not sufficient to pneumatically entrain the particles off the wall 12, but merely serves to at least partially fluidize the body of particles pressed centrifugally against the wall 12.

The contacting of the particles by the air as they spin about the axis A will effectively dry these particles. The drier particles will loose some mass and will naturally move to the top of the bed, here the radially inward surface. At the same time since more wet particles are constantly being added at the lower end of the chamber 82 and since the air coming through the wall 12 is effective with an upward vector the dry particles will move toward the upper end of the chamber 82. As the particles move radially inwardly toward the top of the bed they are less affected by the spinning action.

Finally the bed will become full to a depth such that its inner periphery dimension will be equal approximately to D and the driest particles will spill over the inner lip of the frustoconical portion 14 into the space between the walls 23 and 24.

Since the vessel is spinning in direction 27′ (FIG. 2) many of the particles will pass immediately out of this outlet chamber 88 through the outlet 25. The remaining very dry particles will quickly lose whatever rotational motion they had and become airborne in the exiting current of air leaving the chamber 88 through the outlet 25.

In this manner the particles will be effectively contacted with the drying air from the blower 86 and dried at a very high rate of speed in an apparatus that takes up very little floor space. In addition the rotation speed in direction 27′ can be so great that relatively large particles will remain lying against the wall 12 no matter how dry they become. An automatic sorting is therefore effected in the device.

It is also possible to provide a vibrator 89 connected to the outer wall 13 at its base 15 to vertically reciprocate the two walls 12 and 13 in order to assist vertical motion of the particles. Also an auger or other feed device, even of the vibratory type, may be provided for the inlet tube 2 in order to aid downward flow of the wet particles.

Figure 3:
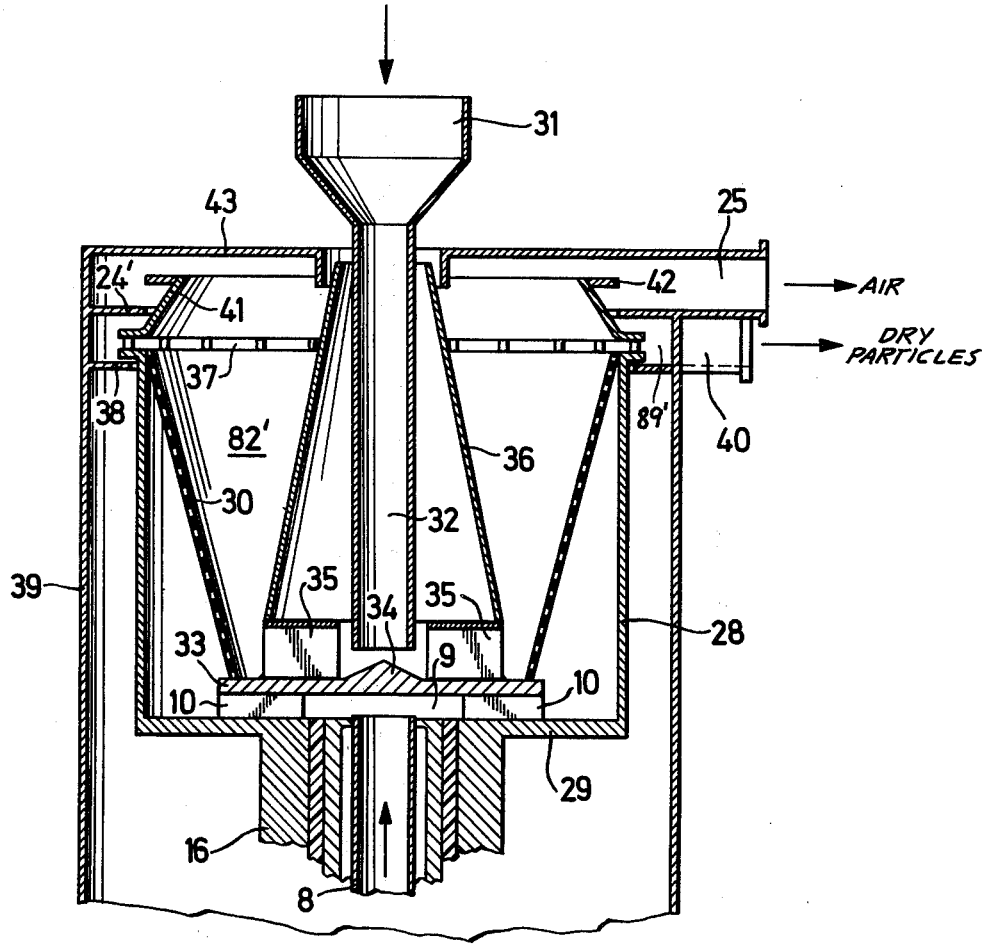
FIGS. 3, 4, and 5 are vertical sections through other arrangements according to this invention.

In FIG. 3 parts having the same structure and function as parts in FIGS. 1 and 2 have the same reference numerals. Here, however, although the outer wall 28 of the vessel is cylindrical and the base 29 is planar as in FIGS. 1 and 2 the foraminous inner wall 30 is frustoconical and extends all the way down to the top of the plate 33 having the distributing cone 34. The inlet tube 32 has a funnel 31 and terminates above this cone 34. Vanes 35 functionally identical to the vanes 5 support an upwardly tapering frustoconical tube 36 that replaces the tube 6 and vanes 7. The parts 30 and 36 are of like conicity but opposite taper. Thus the chamber 82′ tapers downwardly.

Spaced above but connected to the upper edge of the outer wall 28 which joins the upper edge of the inner wall 30 is an upwardly tapering frustoconical ring 41 defining a narrow or radially outwardly open gap 37 with the upper edge of the wall 28. The housing 39 has a flange 38 forming with the flange 24′ an outlet chamber 89′ that has an outlet 40. Otherwise above the plate 24′ an air outlet 25 is provided as in the arrangement of FIGS. 1 and 2. The ring 41 has an outwardly directed flange 22 above the plate 24′ and below the upper wall 43 of the housing 39.

The arrangement of FIG. 3 is effective for the relatively rapid drying of a very fine particle. Little sorting is carried out in this device as all of the particles move relatively rapidly upwardly along the wall 30. Furthermore this arrangement separates air at the outlet 25 from dry particles at the outlet 40 effectively, making it a relatively easy matter to reheat the air and feed it back to the inlet of the blower 86.

Figure 4:
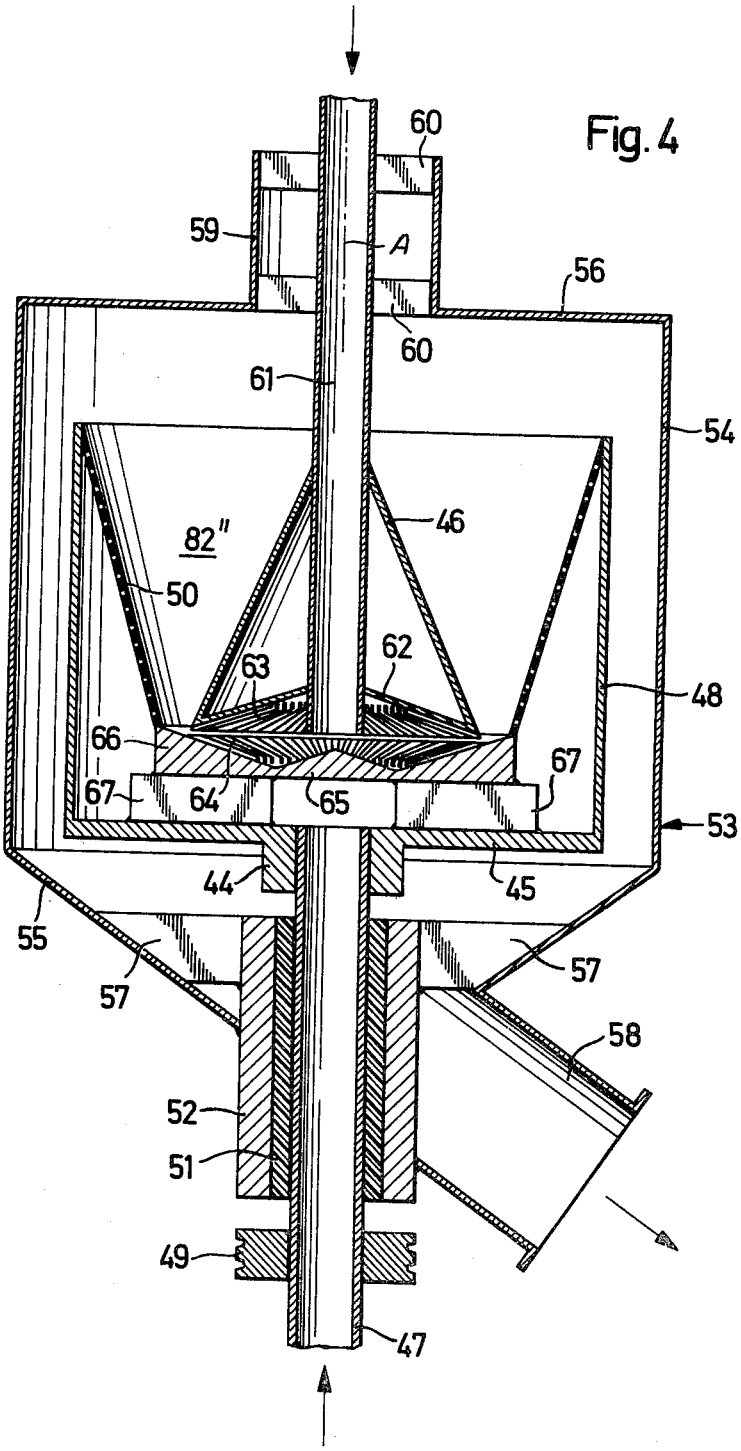

The arrangement shown in FIG. 4 has a housing 53 constituted by a cylindrical side wall 54 having a planar and radially extending upper wall 56 and a downwardly tapered bottom wall 55 forming an outlet 58. Reinforcement plates 57 extending vertically are connected between the lower wall 55 and an outer support sleeve 52 in which is provided a synthetic-resin journal 51 supporting an air-inlet tube 47 for rotation about the axis A. At its lower end the tube 47 is provided with a double-belt pulley 49 and at its upper end is welded to a hub 44 of a horizontal and planar base plate 45 upwardly from which extends a cylindrical side wall 48 centered on the axis A. A downwardly tapered frustoconical inner wall 50 substantially identical to the wall 30 of FIG. 3 has its upper end secured to the upper end of the wall 48 and its lower end secured to the outer periphery of a plate 66 supported by means of vanes 67 identical to the vanes 10 on the base 45. At its center the plate 66 is formed with a distributing cone 65 and around this cone has a frustoconical surface provided with radially directed ribs or ridges 64.

An axially centered inlet tube 61 has its upper end secured by vertically extending support plates 60 to a vertical extension 59 of frustoconical shape on the upper wall 56. At its lower end it opens immediately above the distributing cone 65. A downwardly flared frustoconical element 46 of substantially the same conicity as the wall 50 has its upper end secured to the tube 61 below the upper edges of the walls 48 and 50 and its lower end extending to immediately above the plate 66. Another frustoconical plate 62 of substantially greater conicity than the plate 46 has its inner periphery secured to the tube 61 above its lower end and its outer periphery secured to the lower end of the frustoconical element 36. This plate 62 is formed with ribs or formations 63 identical to the ribs or formations 64.

In use wet particles to be dried are loaded downwardly axially into the upper end of the tube 61 so as to drop onto the distributing cone 65. Lumps in this particulate material will be broken up by the formations 63 and 64 and the material will then slowly migrate up along the rotating inner wall 50. Air rising in the tube 47 will be distributed radially outwardly by the vanes 67 and will fluidize and dry the upwardly moving mass of particles. This air will leave the chamber 82″ through the outlet space between the tube 61 and extension 59. The particles move over the upper edges of the walls 48 and 50 and then fall downwardly along the cylindrical part 54 of the housing. Thereafter the particles will exist from the lower end of the housing 53 at the outlet 58.

Figure 5:
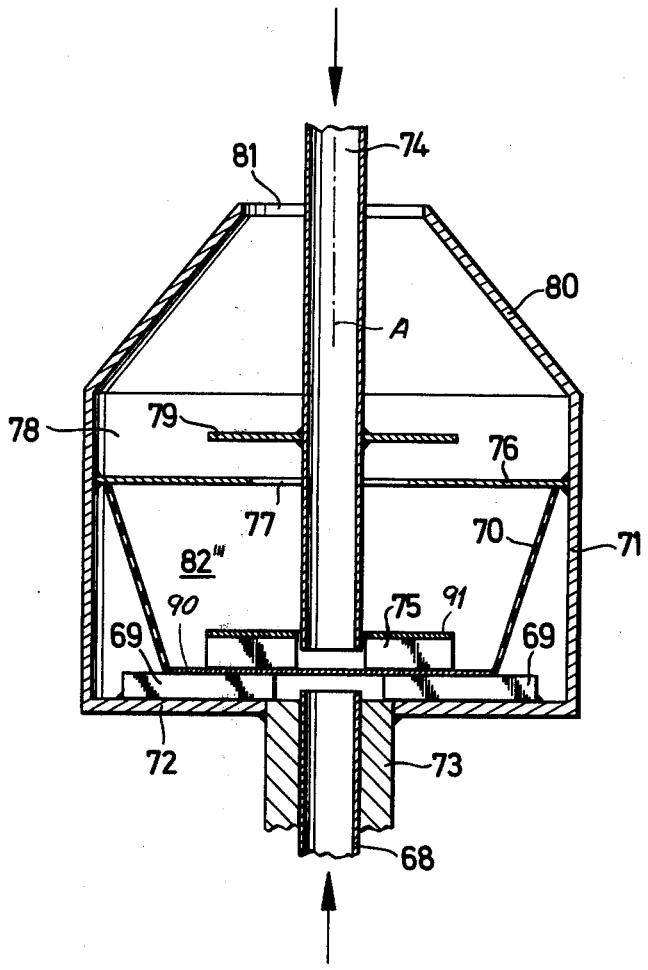

In FIG. 5 a rotatable outer housing has a cylindrical wall 71 provided with a horizontal planar base 72 having a hub 73 centered on the axis A and coaxially surrounding an air-inlet tube 68. Radially extending vanes 69 support a gas-impervious plate 90 upwardly from which extends an upwardly flaring frustoconical foraminous wall 70 whose upper end terminates adjacent the wall 71 underneath an inwardly extending planar plate 76 formed with a central aperture 77.

An inlet tube 74 has a lower end opening between radially extending vanes 75 underneath a plate 91 and is provided above the opening 77 and spaced axially therefrom with a radially extending circular plate 79. The diameter of the plate 79 and of the plate 91 are substantially equal and substantially greater than the diameter of the round hole 77. Thus there is formed above the plate 76 an outlet chamber 78 opening via a relatively small mouth 81 formed by an upwardly tapering frustoconical wall 80 extending upwardly from the upper edge of the wall 71. The diameter of the circular opening 81 is smaller than the diameter of the plate 79 but slightly larger than the diameter of the hole 77.

Thus with the system according to FIG. 5 a relatively deep body measured radially can be formed in the chamber 82'''. Indeed the body of particles will have to have a radial depth sufficient to overflow through the hole 77. The nonrotating plate 79 connected to the nonrotating inlet tube 74 will prevent the particles from flowing directly through the chamber 78 through the inlet 81. Instead another body of particles will build up in the chamber 78 which will overflow through the outlet 81.

This arrangement therefore ensures extremely thorough treatment of the particles in the chamber 82''' and 78 by the gas passing upwardly through the inlet tube 68.

Any features of any of the embodiments described above can be combined with any of the features of any of the other embodiments described above without in any manner departing from the scope or intent of the present invention. All such modifications and combinations are considered to lie within the instant invention.

We claim:

1. A method of treating particles comprising the steps of:

(a) forming said particles into a body of particles centered on an axis;

(b) rotating said body of particles about said axis at a speed sufficient to urge said particles radially outwardly with a centrifugal force;

(c) passing a drying gas in a direction substantially opposite the centrifugal force inwardly through said body all around the latter and thereby contacting said particles and drying same; and (d) maintaining the speed of the gas in said direction at a level sufficient to counter the centrifugal force and keep said particles in a suspended state.

2. The method defined in claim 1 wherein said axis is upright.

3. The method defined in claim 1 wherein said drying gas is passed through said body in a direction forming an angle of at most 10° with a perpendicular from said axis and with the effective direction of the centrifugal force.

4. The method defined in claim 1, further comprising the steps of continuously:

adding particles to said body at one axial end thereof;

withdrawing particles from said body at the opposite axial end thereof; and directing said gas at least partially from said one end toward said other end and thereby entraining said particles axially.

5. The method defined in claim 1, further comprising the step of:

at least partially centrifuging liquid from said body before passing said gas therethrough.

6. An apparatus for drying wet particles, said apparatus comprising:

a vessel adapted to receive wet particles and having a circular cross section with an axis, a foraminous wall surrounding said axis and inlet means for admitting said particles to the vessel;

drive means for rotating said vessel and particles therein about said axis at an angular speed sufficient to urge said particles radially outwardly with a centrifugal force;

a housing spacedly surrounding said vessel and defining a space around said vessel;

drive means for rotating said housing; and blower means for passing a drying gas through said space and at least partially radially inwardly through said foraminous wall and generally opposite to the centrifugal force at a speed sufficient to keep said particles in a suspended state along said wall.

7. The apparatus defined in claim 6 wherein said vessel has said inlet means at one axial end of said vessel and outlet means for said particles in the other axial end of said vessel.

8. The apparatus defined in claim 7 wherein said foraminous wall is cylindrical and said housing means is provided with feed means for supplying a portion of said drying gas to the interior of said vessel in a direction generally perpendicular to the centrifugal force field at least in the region in which said particles are introduced into the interior of said vessel.

9. The apparatus defined in claim 6 wherein said foraminous wall has a conical configuration, said inlet means being provided at the small end of said wall.

10. The apparatus defined in claim 9, further comprising a conical solid-wall body within the foraminous wall and coupled therewith for rotation with said vessel, the small end of said solid wall body being disposed at the wide end of said foraminous wall.

11. The apparatus defined in claim 9, further comprising an annular slit at the wide end of said foraminous wall, and a solid-wall body conically converging away from said slit in the direction of movement of the particles along said foraminous wall.

12. The apparatus defined in claim 7 wherein said axis is vertical and said outlet means is provided at an upper end of said vessel, said inlet means including a central tube reaching downwardly into said vessel and terminating above a hub supporting said vessel at the lower end thereof, said inlet means further comprising a distributing cone aligned with said tube.

13. The apparatus defined in claim 12 wherein said hub is provided with formations for accelerating the outward movement of the particles delivered by said inlet means.

14. The apparatus defined in claim 13 wherein the tube is provided with additional formations spaced from and confronting the first-mentioned formation for accelerating the particles outwardly.

15. The apparatus defined in claim 7 wherein in the region of said outlet means at said one end of said vessel, there is provided a circular-cross section fixed housing portion with tangentially extending discharge duct.

16. The apparatus defined in claim 6 wherein said outlet means includes a tangentially extending discharge duct.

17. The apparatus defined in claim 7, further comprising a stationary jacket spacedly surrounding said housing and formed with a discharge duct constituting part of said outlet means.

18. The apparatus defined in claim 6, further comprising means for axially vibrating said vessel.

19. The apparatus defined in claim 6 wherein radially inwardly of the foraminous wall there is provided a tubular inner body formed externally with vanes or rotatable entrainment of a fluid.

* * * * *